US006899112B2

(12) United States Patent
Tsai

(10) Patent No.: US 6,899,112 B2
(45) Date of Patent: May 31, 2005

(54) TENT STRUCTURE

(76) Inventor: Ming-Liang Tsai, Rm. 3, 4th Floor, No. 8, Fu Ching Street, Taipei (TW)

( * ) Notice: Subject to any disclaimer, the term of this patent is extended or adjusted under 35 U.S.C. 154(b) by 88 days.

(21) Appl. No.: 10/637,668

(22) Filed: Aug. 11, 2003

(65) Prior Publication Data

US 2005/0055892 A1 Mar. 17, 2005

(51) Int. Cl.[7] ..... E04H 15/50
(52) U.S. Cl. ..... 135/131; 135/145; 135/159; 135/160; 52/222
(58) Field of Search ..... 135/129–131, 135/143–146, 158–160; 52/222, 223.14

(56) References Cited

U.S. PATENT DOCUMENTS 1,853,367 A * 4/1932 Mace ..... 135/123
4,779,635 A * 10/1988 Lynch ..... 135/97
4,947,884 A * 8/1990 Lynch ..... 135/97
5,490,532 A * 2/1996 Mallookis et al. ..... 135/117

* cited by examiner

*Primary Examiner*—Robert Canfield
(74) *Attorney, Agent, or Firm*—Rosenberg, Klein & Lee

(57) ABSTRACT

A tent structure includes supporting legs, linkages connected between every two neighboring supporting legs, and a head support. The supporting legs are standing on the ground and equally spaced from each other. Every two neighboring supporting legs are connected with one of the linkages. The head support includes rods and retractable rods. Each of the retractable rods comprises an elastic member engaging with the rod to adjust the length of the rod extending or retracting within the retractable rod. When a tarpaulin is placed on the head support, the retractable rods may extend its length to the degree that the tarpaulin is fully expanded and secured.

2 Claims, 10 Drawing Sheets

D

A

B

C

D

E

F

TENT STRUCTURE

FIELD OF THE INVENTION

This invention relates to a tent, and more particularly to a tent structure which is able to adjust the tension of the tarpaulin by means of retractable rods.

BACKGROUND OF THE INVENTION

There are many types of tents on the market, and they can be characterized into open and closed types. The closed type tent is normally formed in a dome or any shape that has a tarpaulin extended all the way to the ground. The open type tent generally comprises a tarpaulin covering the top of the structure, which is convenient for people to walk in and out and for air flowing through and is convenient for carriage, such as U.S. Pat. Nos. 5,701,923 and 6,035,877. All of which are designed in a foldable type. However, most of the tents are designed with a slanting roof for draining water, which elevates a center pole with respect to side supporting legs. This design is not strong enough to hold the tarpaulin and may form a dent to collect water, which gains weight to the poles and collapses the tent.

It is therefore a desire for the inventor to provide a renovated tent structure.

SUMMARY OF THE INVENTION

It is the primary object of the present invention to provide a tent structure, which has an adjustable canopy to avoid forming a pool to collect water.

It is another object of the present invention to provide a tent structure, which is easy to adjust the tension of the canopy.

It is a further object of the present invention to provide a tent structure, which is cost effectiveness.

DETAILED DESCRIPTION OF THE PREFERRED EMBODIMENT

Figure 1:
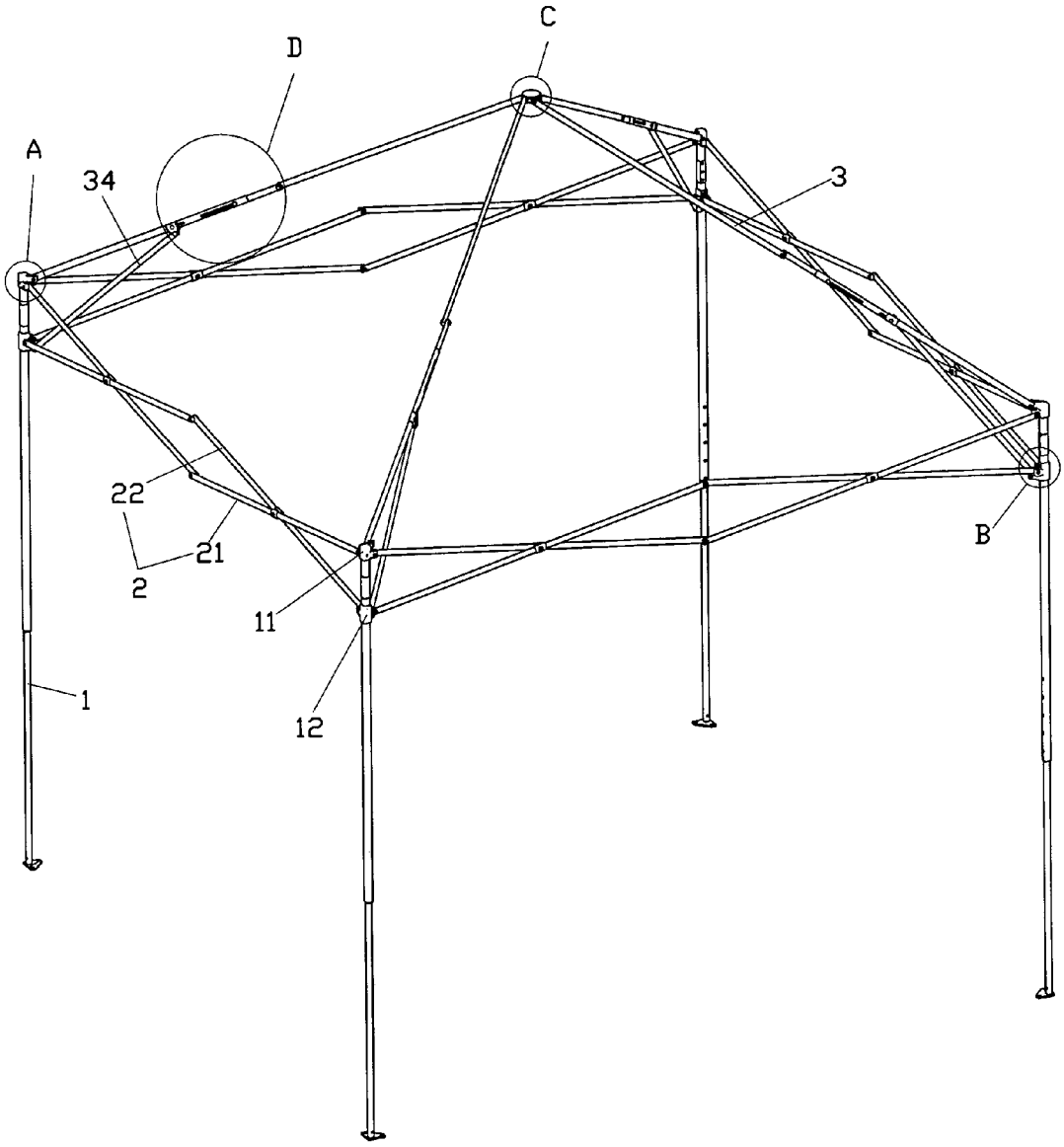
FIG. 1 is a perspective view of a preferred embodiment the present invention.

The tent structure of the present invention comprises supporting legs 1, linkages 2 connected between every two neighboring supporting legs 1, and a head support 3, as shown in FIG. 1.

Figure 2:
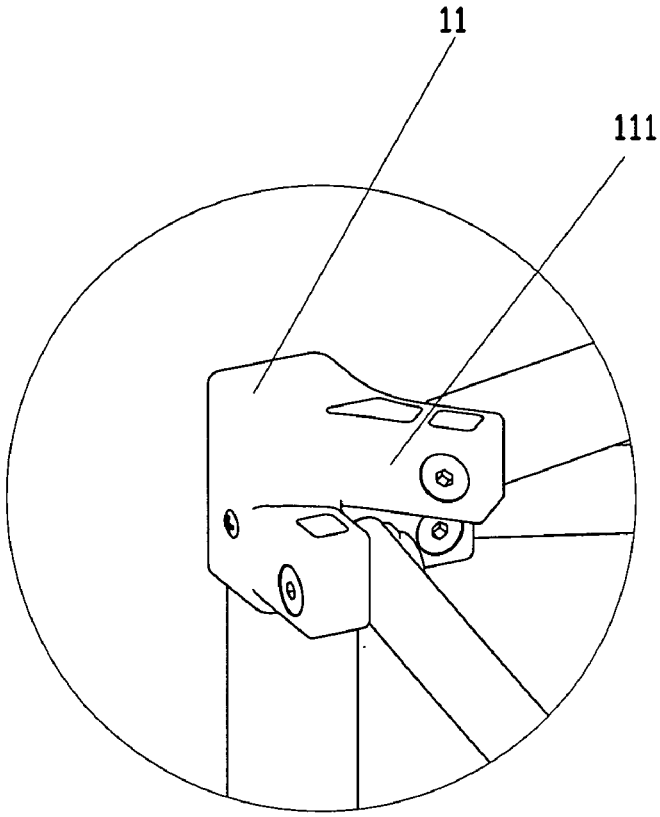
FIG. 2 is an enlarged view of the portion of the preferred embodiment identified by circle A in FIG. 1.
Figure 3:
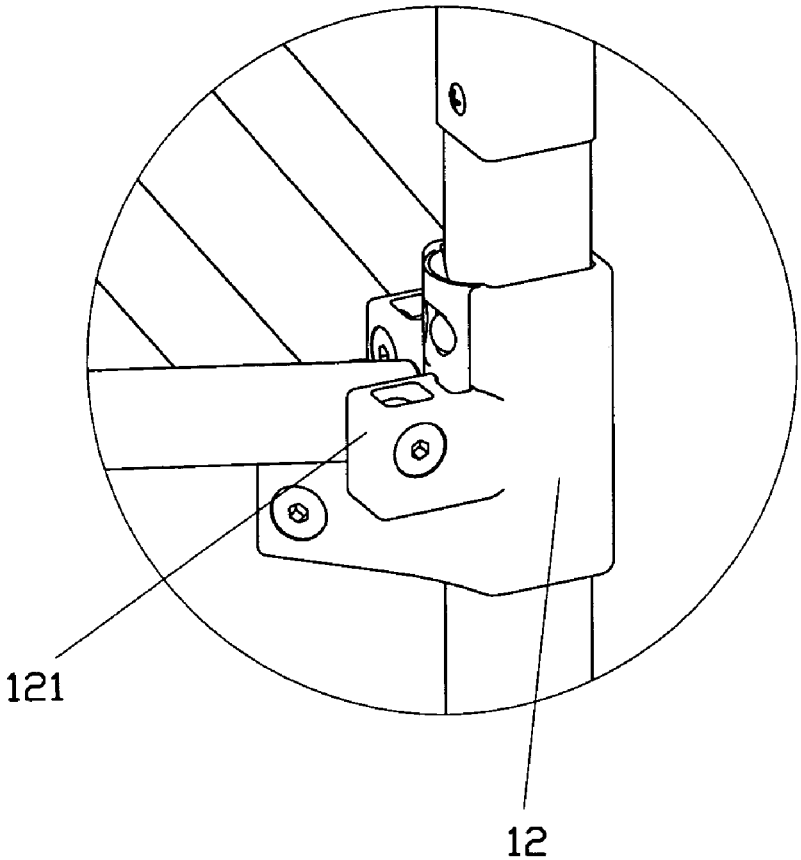
FIG. 3 is an enlarged view of the portion of the preferred embodiment identified by circle B in FIG. 1.

The supporting legs 1 are standing on the ground and spaced from each other to form an enclosed area. This illustration has adapted four supporting legs 1, and every two supporting legs 1 are connected with one corresponding linkage 2. Each supporting leg 1 is provided with a first connector 11 and a second connector 12 at the upper potion thereof. The first connector 11 comprises three arms 111 facing towards different angles, and the second connector 12 also comprises three arms 121 facing towards different angles, as shown in FIGS. 2 and 3.

Each of the linkages 2 is formed with a pair of rods 21 and 22 connected together at the center portions to an X-shape frame, and two ends of the X-shape frame are connected with two ends of another X-shape frame, which forms a double X-shape frame. The rest two ends of the rods 21 and 22 are respectively connected to one arm 111 and 121 of the first connector 11 and the second connector 12.

Figure 4:
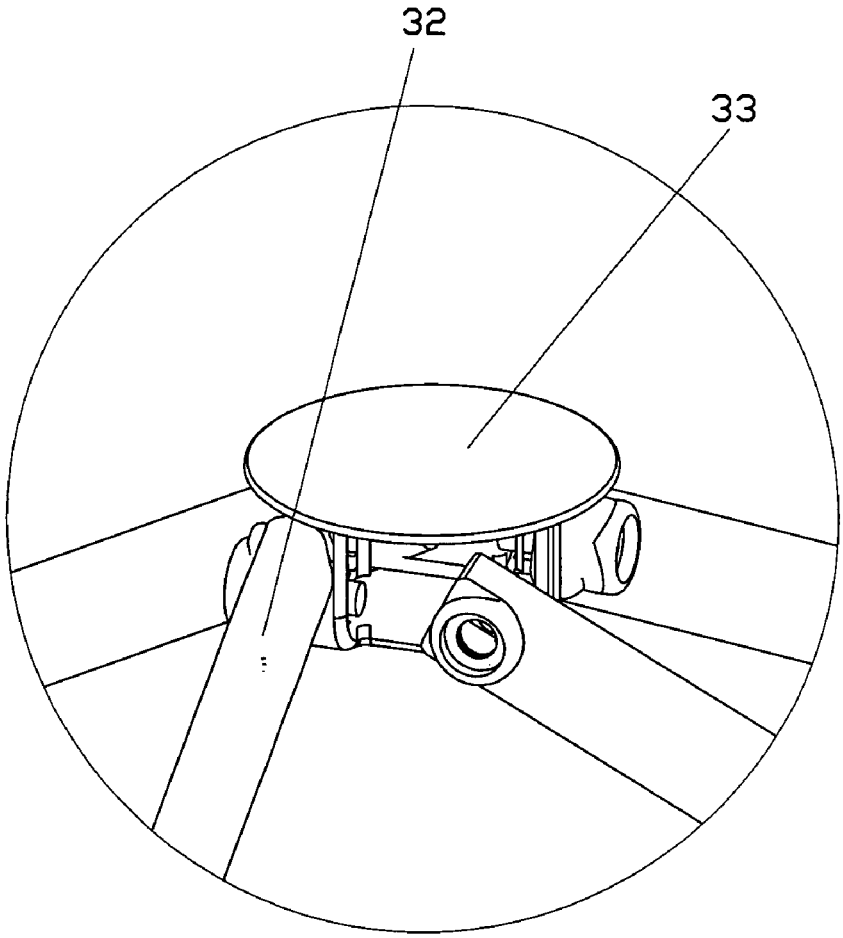
FIG. 4 is an enlarged view of the portion of the preferred embodiment identified by circle C in FIG. 1.
Figure 5:
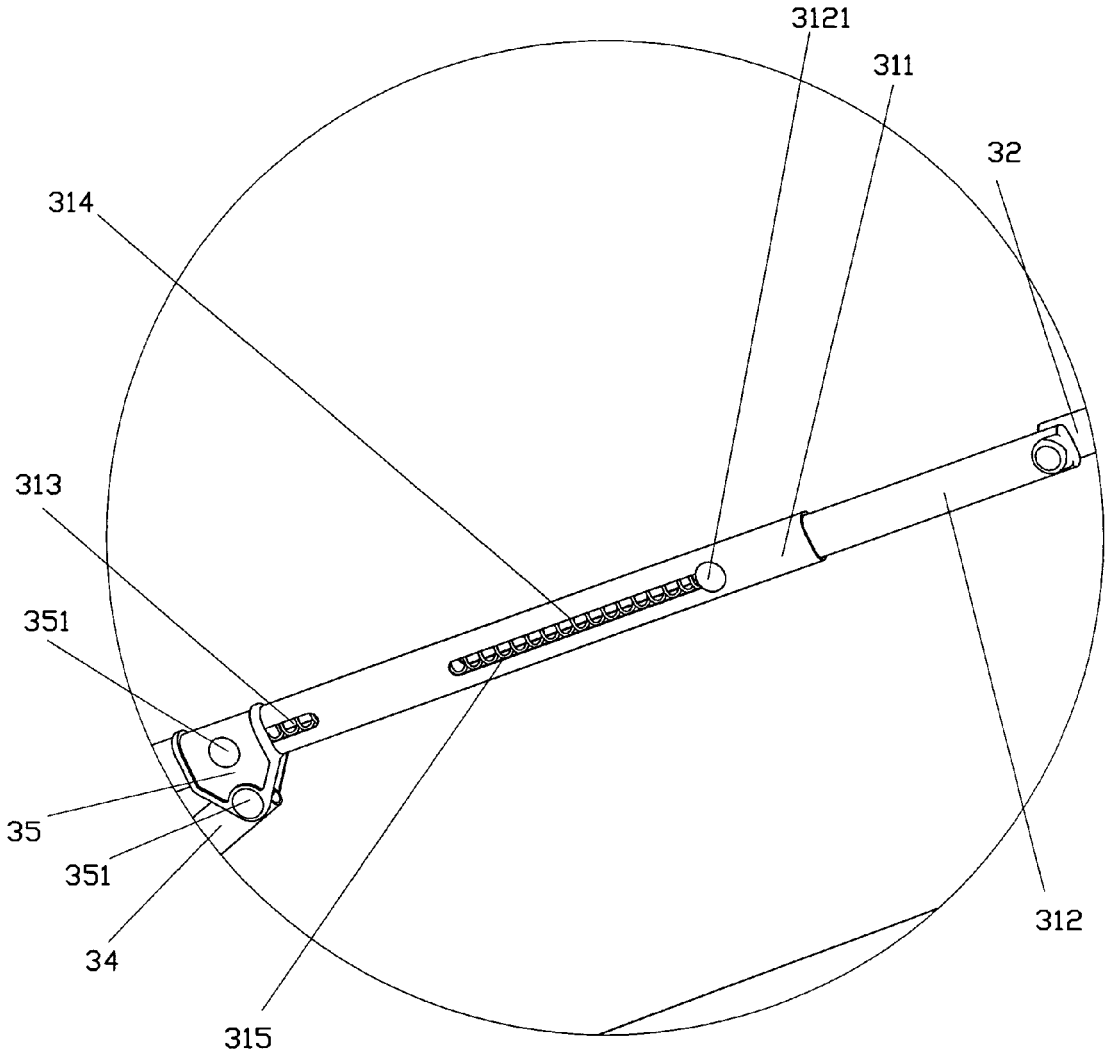
FIG. 5 is an enlarged view of the portion of the preferred embodiment identified by circle D in FIG. 1.
Figure 6:
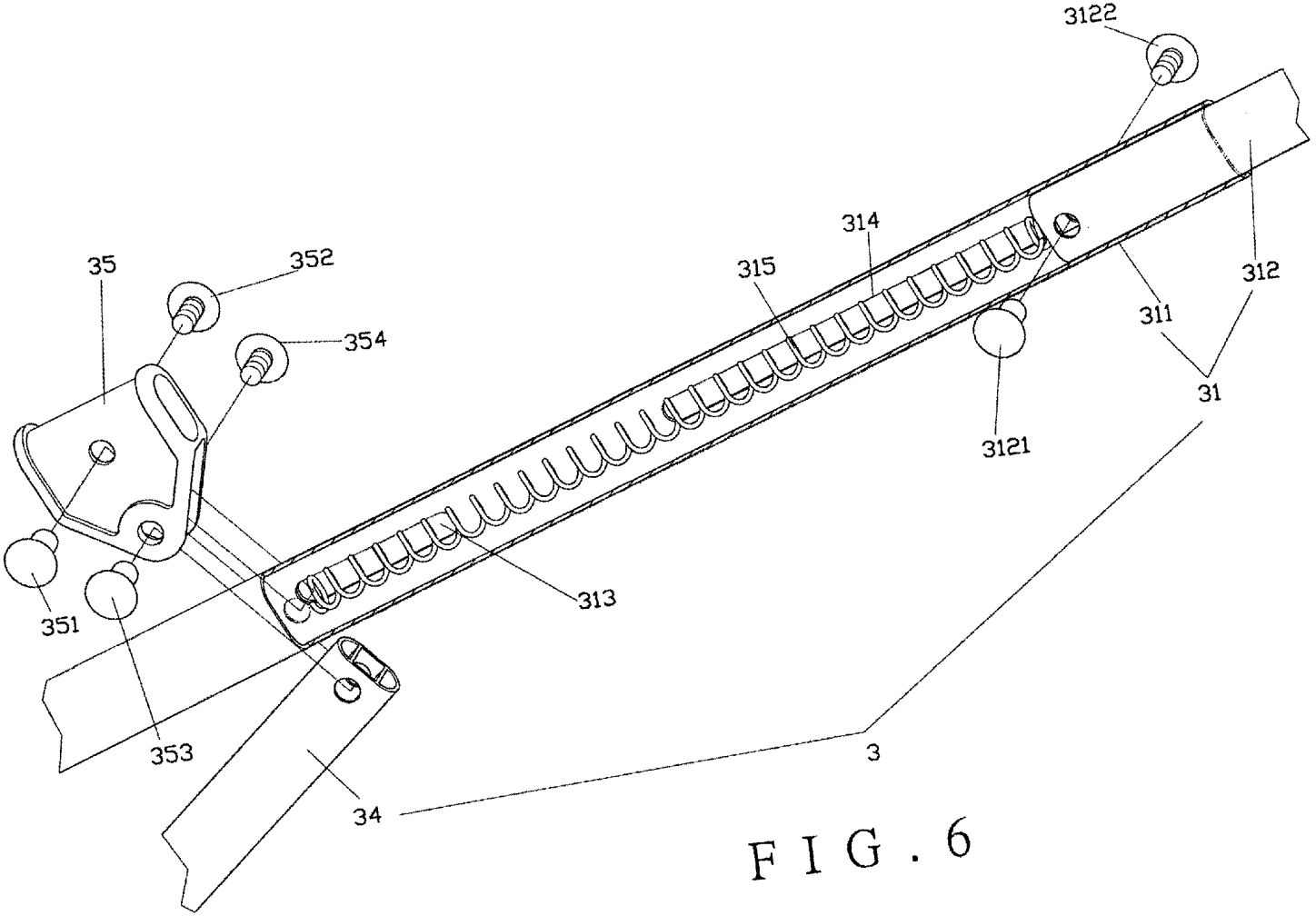
FIG. 6 is an exploded view of a retractable rod of the present invention.

As shown in FIGS. 4 to 6, the head support 3 comprises four retractable rods 31, four rods 32, a connecting seat 33, four reinforcing rods 34, and four sliding fittings 35. One end of each rod 32 is connected to the connecting seat 33. Each reinforcing rods 34 has one end secured within the corresponding sliding fitting 35 and the other end secured to the corresponding second connector 12. Each retractable rod 31 is located between the other end of the rod 32 and the top end of the supporting leg 1. Each retractable rod 31 includes a sleeve 311, a sliding rod 312 and an elastic member 315 seated in the sleeve 311. The sliding rod 312 has one end sleeved into the sleeve 311 and engaging against the elastic member 315. (This illustration uses a nut 3121 and a bolt 3122 threaded together at one end of the elastic member 315.) The other end of the sleeve 311 is engaged with the top end of the corresponding supporting leg 1. The sliding fitting 35 is sleeved on the sleeve 311. The sliding rod 312 has another end connected to the rod 32 and is controlled by the elastic member 315 in the retractable rod 31 to extend, which then pushes the rod 32 to extend as well.

FIGS. 1, 5 and 6, have more details about the head support 3 and the retractable rods 31. The sleeve 311 of the retractable rod 31 comprises a pair of slots 313 and 314 at respective ends along the axis. The sleeve 311 has another end connected to one arm 111 of the first connector 11 of the supporting leg 1. The sliding fitting 35 is sleeved on the sleeve 311 by a nut 351 and a bolt 352 which are inserted into the slot 313. One end of the reinforcing rod 34 is pivotally connected to the sliding fitting 35 by a nut 353 and a bolt 354 thereof. The nut 351 engages with one end of the elastic member 315 in the slot 313, and the nut 3121 secures the sliding rod 312 in the sleeve 311 and is engaged with the other end of the elastic member 315.

Figure 7:
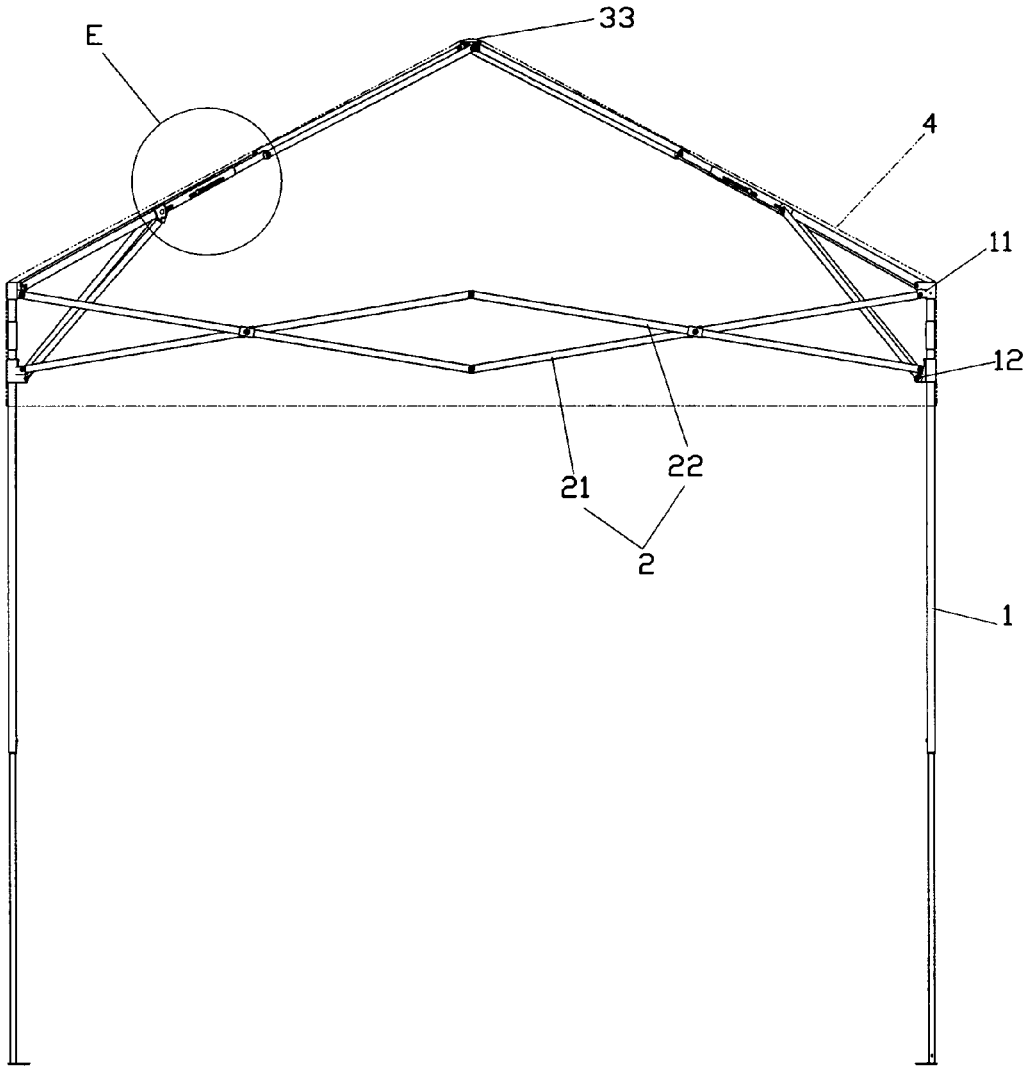
FIG. 7 is a front view of the present invention.
Figure 8:
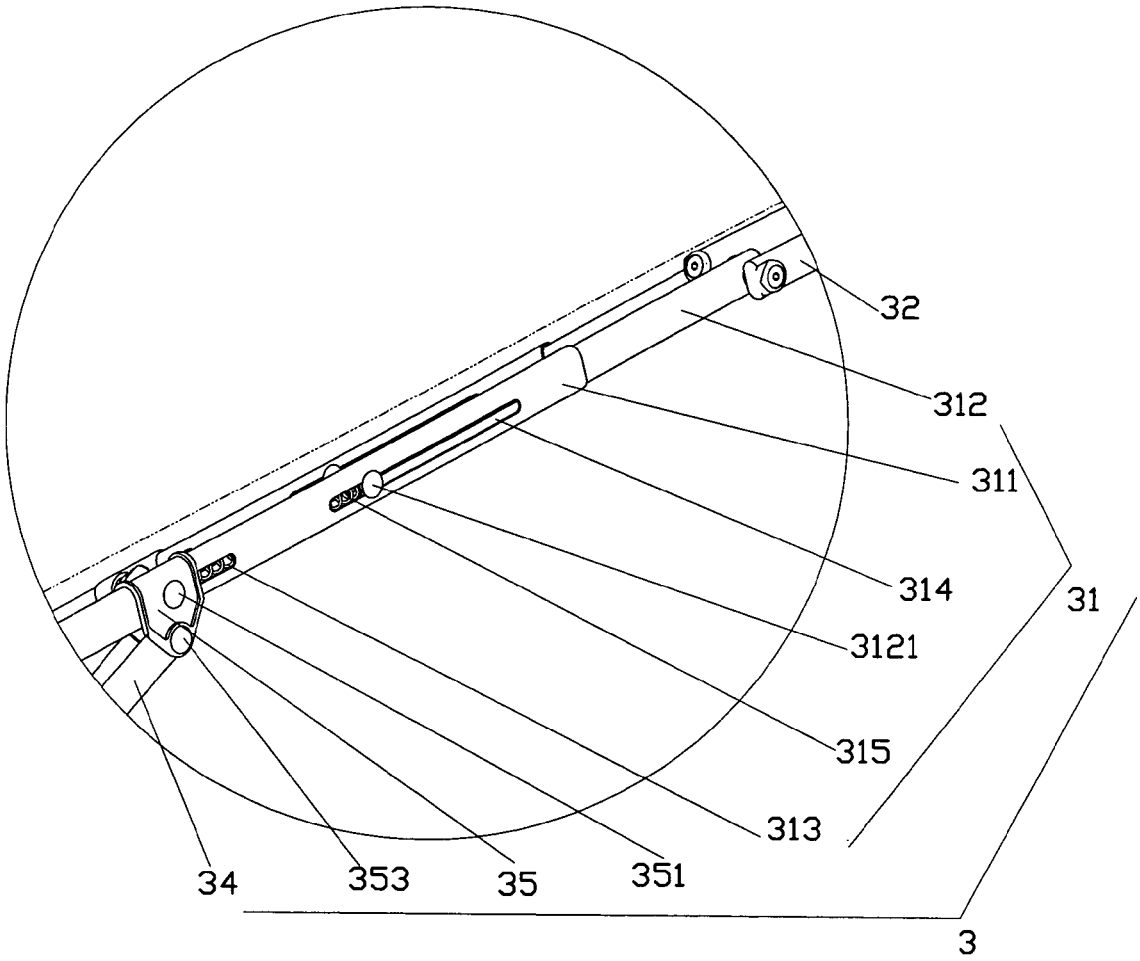
FIG. 8 is an enlarged view of the portion of the preferred embodiment identified by circle E in FIG. 7.

In such an arrangement, when placing a tarpaulin 4 on the head support 3, as shown in FIGS. 7 and 8, the tension from the supporting legs 1 tightens the tarpaulin 4 to the utmost. When applying with a new tarpaulin 4, the tarpaulin 4 still has an elastic character, which also provides a pressure against the connecting seat 33 of the head support 3 and forces each retractable rod 31 unable to expand thoroughly. This presses the elastic member 315 in the retractable rod 31 to contract.

Figure 9:
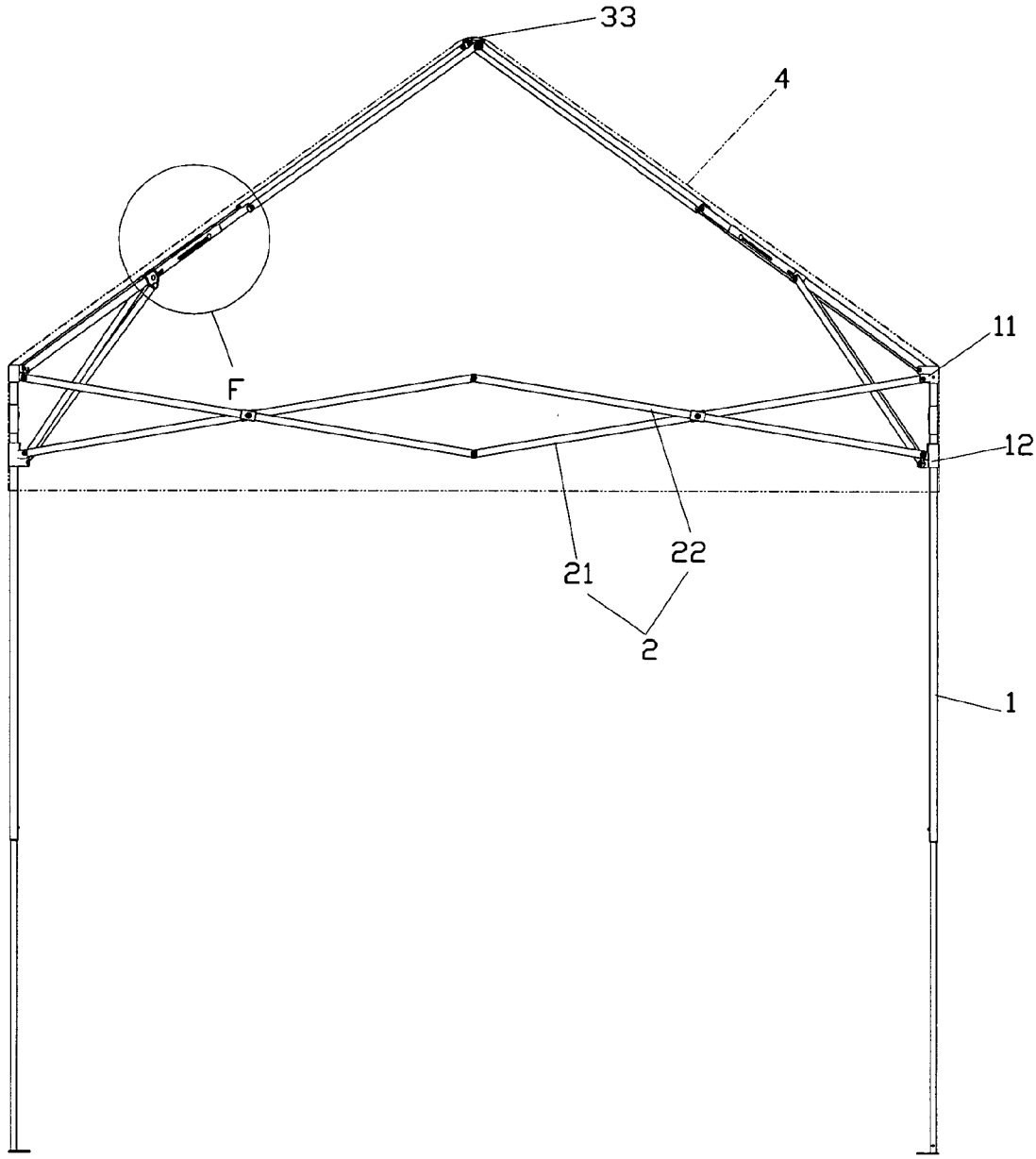
FIG. 9 is a front view depicting expansion of the tent of the present invention.
Figure 10:
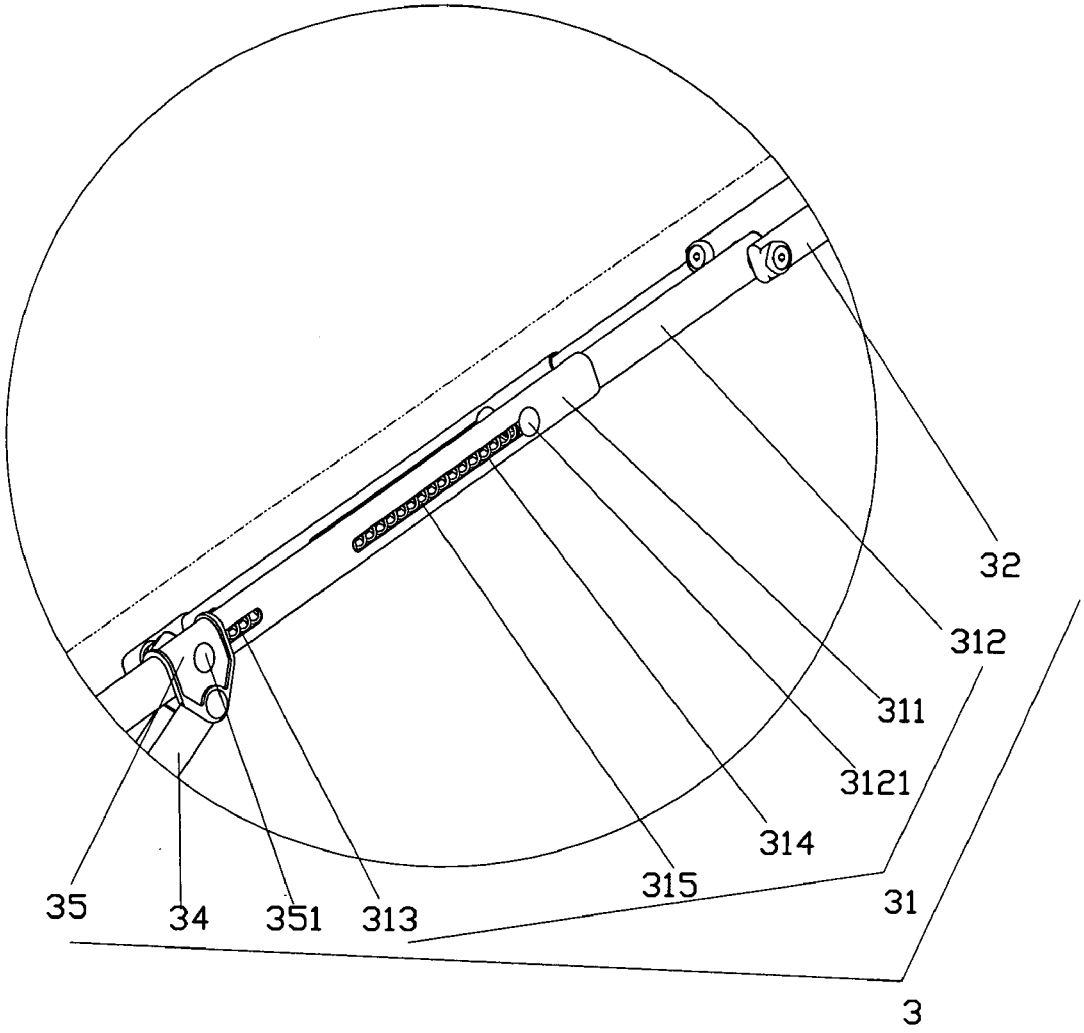
FIG. 10 is an enlarged view of the portion of the preferred embodiment identified by circle F in FIG. 9.

After a certain period of time, the tarpaulin 4 will loose its elastic character, as shown in FIGS. 9 and 10. The tension from the tarpaulin 4 against the retractable rods 31 is less strong. The elastic member 315 of each retractable rod 31 begins to push the rod 32 to extend within the retractable rods 31, which then stretches the tarpaulin 4 to expand and the tarpaulin 4 remains stretch out status.

I claim:

1. A tent structure comprising at least four supporting legs, four linkages and a head support, wherein said supporting legs being standing on the ground and equally spaced from each other, every two neighboring supporting legs being connected with one of said linkages, said head support comprising rods, a connecting seat, reinforcing rods and sliding fittings, wherein each said rod having on one end connected to said connecting seat, each said reinforcing rod having one end connected to said corresponding sliding fitting and another end connected to an upper portion of said corresponding supporting leg, wherein the improvement comprises:

said head support further comprising retractable rods, each said retractable rod including a sleeve, a sliding rod and an elastic member, wherein said elastic member being secured within said sleeve, each said sliding rod having one end enclosed within said sleeve and engaging with one end of said elastic member, another end of said sleeve being secured to a top end of said supporting leg, said sliding fitting covering one portion of said sleeve, another end of said sliding rod being connected with another end of said rod, by means of said elastic member within said retractable rod, a pushing force being applied to said sliding rod and to said rod.

2. The tent structure, as recited in claim 1, wherein said sleeve of each said retractable rod comprises a pair of slots, and two ends of said elastic member are pivotally connected to one end of said sliding rod and said sliding fitting, respectively, by pivoted members inserted through said slots.

* * * * *